United States Patent [19]

Mason

[11] 4,267,670

[45] May 19, 1981

[54] COMBINED DUPLICATOR AND PREFORMER FOR LAPIDARY USE

[76] Inventor: Gene C. Mason, 11531 Tulary Way, Marysville, Wash. 98270

[21] Appl. No.: 942,691

[22] Filed: Sep. 15, 1978

[51] Int. Cl.[3] ..... B24B 9/16

[52] U.S. Cl. ..... 51/101 R; 51/229

[58] Field of Search ..... 51/101 LG, 101 R, 229

[56] References Cited

U.S. PATENT DOCUMENTS

| | | | |
|---|---|---|---|
| 1,998,642 | 4/1935 | Smith | 51/229 |
| 3,073,085 | 1/1963 | Ticino | 51/229 |
| 3,834,085 | 9/1974 | Moeller | 51/229 |
| 3,844,070 | 10/1974 | Reed | 51/229 |
| 3,861,090 | 1/1975 | Lattauzio | 51/229 |
| 4,084,352 | 4/1978 | Wheeler | 51/229 |
| 4,110,937 | 9/1978 | Bein | 51/229 |

*Primary Examiner*—Harold D. Whitehead

*Attorney, Agent, or Firm*—Seed, Berry, Vernon & Baynham

[57] ABSTRACT

A lapidary machine is provided with a grinding wheel and a removable hinged adjustable fixture arranged to swing toward and away from a grinding surface on the wheel and having an adjustable slide carrying a guide bar and a swing arm on which is journaled an arbor having a chuck for a dop, a template, and a turning knob. The template is swung against a guide surface on the guide bar and turned to establish the grinding pattern of the grinding wheel on a cabochon blank or the like mounted on the dop.

3 Claims, 16 Drawing Figures

49
48
A
38
50
39
B
C
41
26
42

69
68
66
59
67
56
55
65
52
53
63
54
57
62
62a
58
64
66·A
66·B
66·C
66·D
66 E
66·F
55·A

COMBINED DUPLICATOR AND PREFORMER FOR LAPIDARY USE

BACKGROUND OF THE INVENTION

1. Field of the Invention

The present invention relates to preforming and duplicating operations on lapidary machines, and more particularly to the grinding of cabochons from stone blanks.

2. Description of the Prior Art

The forming of a cabochon from a rough stone blank involves grinding the blank to the desired peripheral size and shape and with a selected bezel angle, and then grinding the face of the blank to the desired domed curvature. In the past the first of these steps was performed by free-hand holding the blank against a rotary grinding surface and grinding the blank to a perimeter line marked on the stone by reference to a selected template, or by use of a duplicator having special templates. Heretofore such a duplicator has operated with the stone blank arranged with its plane coinciding with the plane of the grinding wheel, and hence, when the cabochon is to be oval shaped the point of grinding contact between the periphery of the grinding wheel and the periphery of the stone blank varies as the blank is turned to progressively expose its periphery to the grinding surface. As a consequence, the duplicator template must be compensated in shape from the oval desired for the cabochon, and this means that a special template is required for each size and shape of cabochon.

Automatic cabochon grinding machines have been developed to form both the periphery and domed curvature of a cabochon, but these machines require use of a special diamond faced wheel concavely shaped at its periphery in conformance with a quadrant of the particular cabochon to be formed. These machines are relatively expensive and require a respective special grinding wheel for each cabochon size and shape.

SUMMARY OF THE INVENTION

The present invention aims to provide a relatively inexpensive device whereby a wide range of cabochon shapes and sizes can be ground while using duplicator templates which do not require compensation and while using a standard lapidary grinding wheel. More particularly, the invention aims to provide such a device by which several cabochon sizes of like shape can be ground by the use of a single duplicator template having such shape.

Another object is to provide such a device which can be readily used as an attachment on a lapidary machine and is relatively easy to operate.

In accordance with the present invention, there is provided a grinding fixture having a slide and a slideway which is swing mounted on a lapidary grinding machine so that the slide can be moved toward or away from the grinding wheel at a variety of angles. The slide has a laterally projecting guide face for guiding a template which is mounted on an arbor journaled on a swing arm pivotally mounted on the slide. The arbor has a chuck at one end for receiving a dop so that a stone blank carried by the dop can be moved against the grinding surface and turned in unison with the template as it is manually turned by a knob on the arbor while the template swings into engagement with the guide face. The overall arrangement is such that the point of contact of the grinding wheel with the stone blank remains constant, and hence the template can be exactly the same shape as the desired cabochon.

DETAILED DESCRIPTION OF THE PREFERRED EMBODIMENTS

Figure 1:
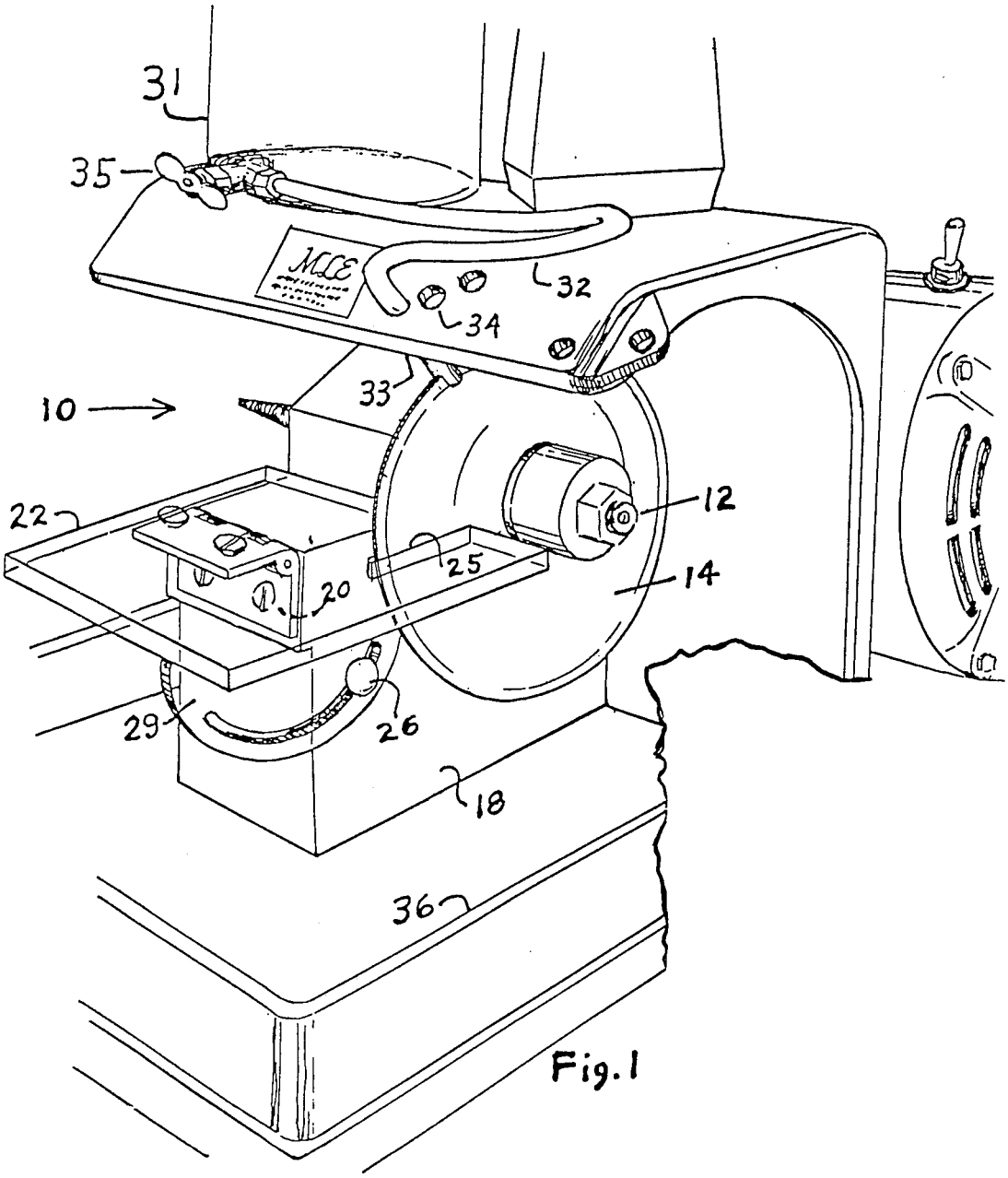
FIG. 1 is a perspective view showing a lapidary machine fitted with a cutting wheel and tilting table.
Figure 2:
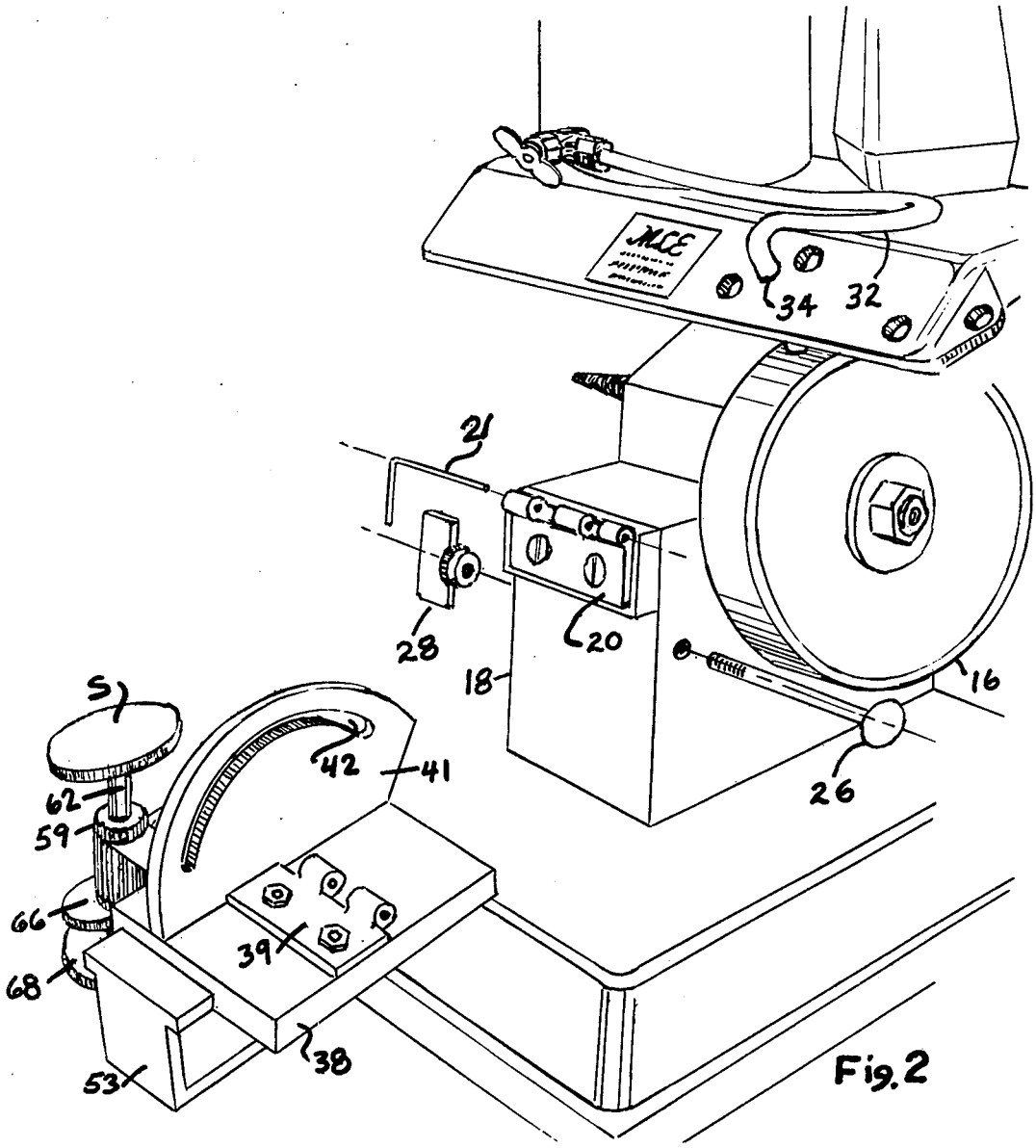
FIG. 2 is a perspective exploded view of the lapidary machine shown in FIG. 1 with the tilting table removed, a grinding wheel substituted for cutting wheel, and a device in accordance with the present invention shown inverted.
Figure 3:
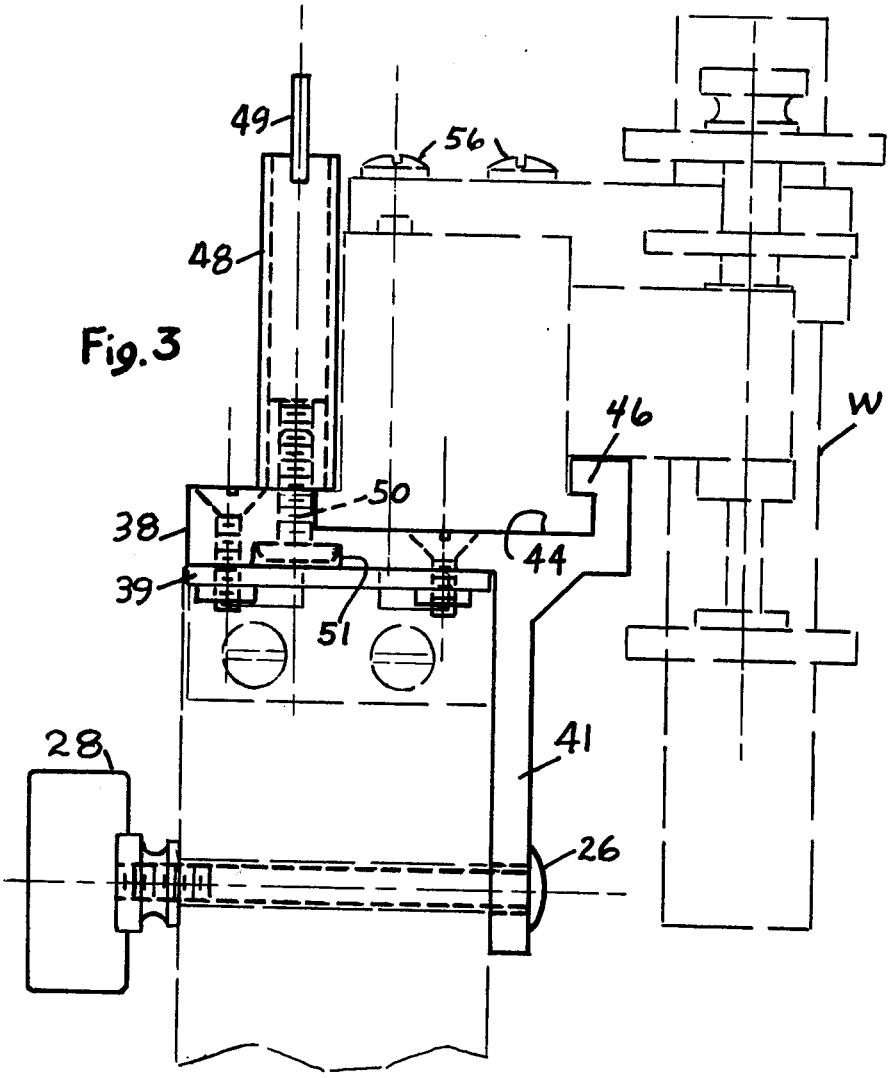
FIG. 3 is an end view showing the tilting support member and related components in full line and the slide member and related components phantom.

Referring to FIGS. 1 and 2 there is illustrated a lapidary machine 10 having a power driven shaft 12 for a cutting wheel 14 or grinding wheel 16. The machine has a mounting base 18 forwardly of the shaft 12 on which is secured a hinge leaf 20. As shown in FIG. 1, when a cutting operation is to be performed by wheel 14 an adjustable table 22 is used having a hinge leaf 24 on its underside registering with the leaf 20 by a removable hinge pin 21. This table 22 has a rear slot 25 to receive the blade 14 and has an arcuately slotted sector plate 29 depending from its underside to receive an angle adjustment bolt 26 passing through an opening 27 in the base 18 and secured by a wing nut 28. The machine 10 has a hood 30 on which is mounted a water storage tank 31 from which a hose 32 leads for insertion through a selected of holes 34 in the hood to direct a gravity fed stream of water on the wheel controlled by a valve 35. The water is gathered in a base tank 36.

As part of the present invention there is provided a support member 38 having a hinge leaf 39 on its underside to hingedly interfit with the leaf 20 by way of the hinge pin 21. The member 38 has a depending sector 41 with an arcuate slot 42 arranged to receive the adjusting bolt 26 and is formed with a slideway 44 defining a slide plane and extending front to back to receive a slide plate 45. The arrangement of the slideway 44 and the swing axis defined by the longitudinal axis of the hinge pin 21 is such that the swing axis is parallel to the slide plane of the slideway 44 and extends laterally at right angles relative to the length of the slideway 44. When mounted as indicated in FIG. 2 for use of the grinding band surface at the periphery of the grinding wheel on the work piece, the hinge pin 21 is parallel with the rotary exis of the grinding wheel. It will be noted that the outer longitudinal side of the slideway has an overhanging retaining lip 46 and that this is complemented at the inner longitudinal side by an elongated clamping nut 48 having a T-head 49. This nut 48 is threaded on a clamping screw 50 which has its head seated in a recess 51 on the underside of the support member 38 and projects upwardly through the latter alongside the slideway 44 with a force fit preventing turning of screw 50 while the nut 48 is tightened to bear by its lower end against a top marginal portion of the support member. The portion of the upper surface of the support plate 38 beneath the nut 48 is slightly recessed so that the nut can bear down firmly against the slide plate 45 to hold it in selected position.

A support head 53 of inverted U-shaped configuration is fixed on the member 38 and carries a laterally extending swing head 52 mounted on the plate 38 by a pivot pin 54. Also mounted on the support head 50 is a laterally projecting guide bar 55 of forked configuration held in place by screws 56 extending through holes in the inner end portion of the guide bar. At its outer end the swing head 52 has a vertical bore 57 receiving an arbor 58 which has an integral chuck 59 at its lower end with a center bore 60 to receive a dop 62 held in place by a set screw 63. Toward its upper end the arbor 58 has a circumferential groove 64 for a snap ring 65 to hold the arbor axially in position, and is necked and threaded to receive a template 66, a spacer sleeve 67, a transparent turn knob 68, and a knurled nut 69 holding the knob 68 and template 66 on the arbor so that they will turn in unison with the dop 62 as the knob 68 is turned. The front face 55*a* of the guide bar 55 is planar to guide the template 66 and is arranged to be parallal to the longitudinal axis of the arbor 58, and hence parallel to the axis of the dop 62.

In the drawings a rough cut stone S to be cut is shown cemented at 72 to the flat enlarged head 62*a* of the dop 62 in the conventional manner. A template 66 is selected of the desired size and shape for the finished stone. The sector 41 is then adjusted so that the planar guide face 55*a* is vertical and tangential to the grinding wheel. The operator then swings the template 65 into engagement with the guide face 55*a* and, as the rotating grinding wheel cuts away the periphery of the stone, the knob 67 is slowly turned and the template kept in engagement with the guide face 55*a* by pressing gently on the swing arm 52 at a point about midway between the template and the stone blank. As a result, the stone is ground to the same peripheral shape as the selected template 65. This grinding occurs along a line in space which is parallel to the rotary axis of the grinding wheel and to the line of engagement of the template with the guide face 55*a*.

Figure 4:
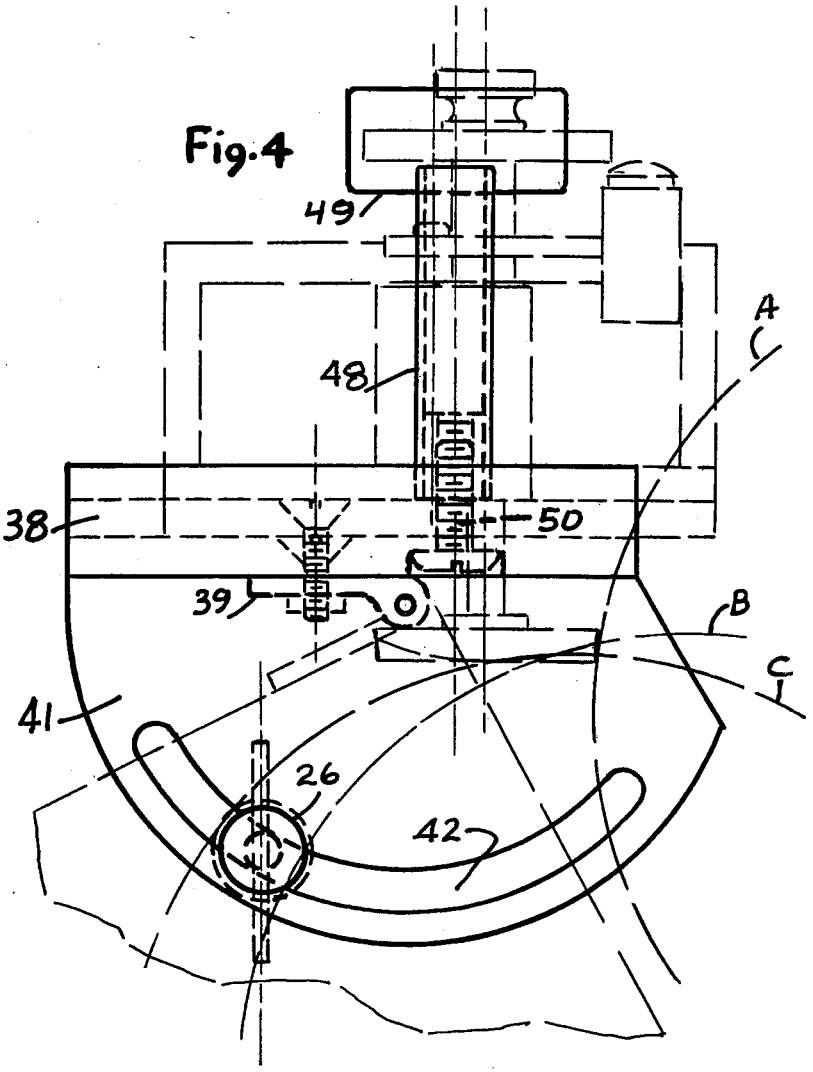
FIG. 4 is a side elevational view of the structure illustrated in FIG. 3.

Normally it is desired to give the stone a bezel angle of 7 to 15 degrees. This is done by initially adjusting the sector 41, so that the guide surface 55*a* is at the desired bezel angle from the vertical. This is indicated by position A of the wheel in FIG. 4. To then crown the stone to a domical shape the sector 41 is adjusted so that the stone is ground in the manner above described, but with the relative angle of the guide face and wheel being changed as indicated by position B. Further grinding can then be done in position C. More graduations in the relative angle can, of course, be made. In FIG. 4, for illustrative purposes, the grinding wheel is shown as moved to show relative positions B and C whereby, of course, on the machine the dop is moved correspondingly relative to the grinding wheel by angular adjustment of the sector 41.

In the above described example the desired cabochon was the same size as the template. However, this is not necessary. When it is desired to make a smaller cabochon of the same shape the slide 53 is moved closer to the grinding wheel in correspondence to the desired radial reduction in the cabochon so that the grinding wheel will then have to cut the stone an amount greater than before in order for the template to engage the guide face 55*a*. In this manner various smaller sizes of cabochons of like shape can be cut by the use of a single template.

Figures 5, 6, 7, 8, 9, 10, 11, 12, 13, 14:
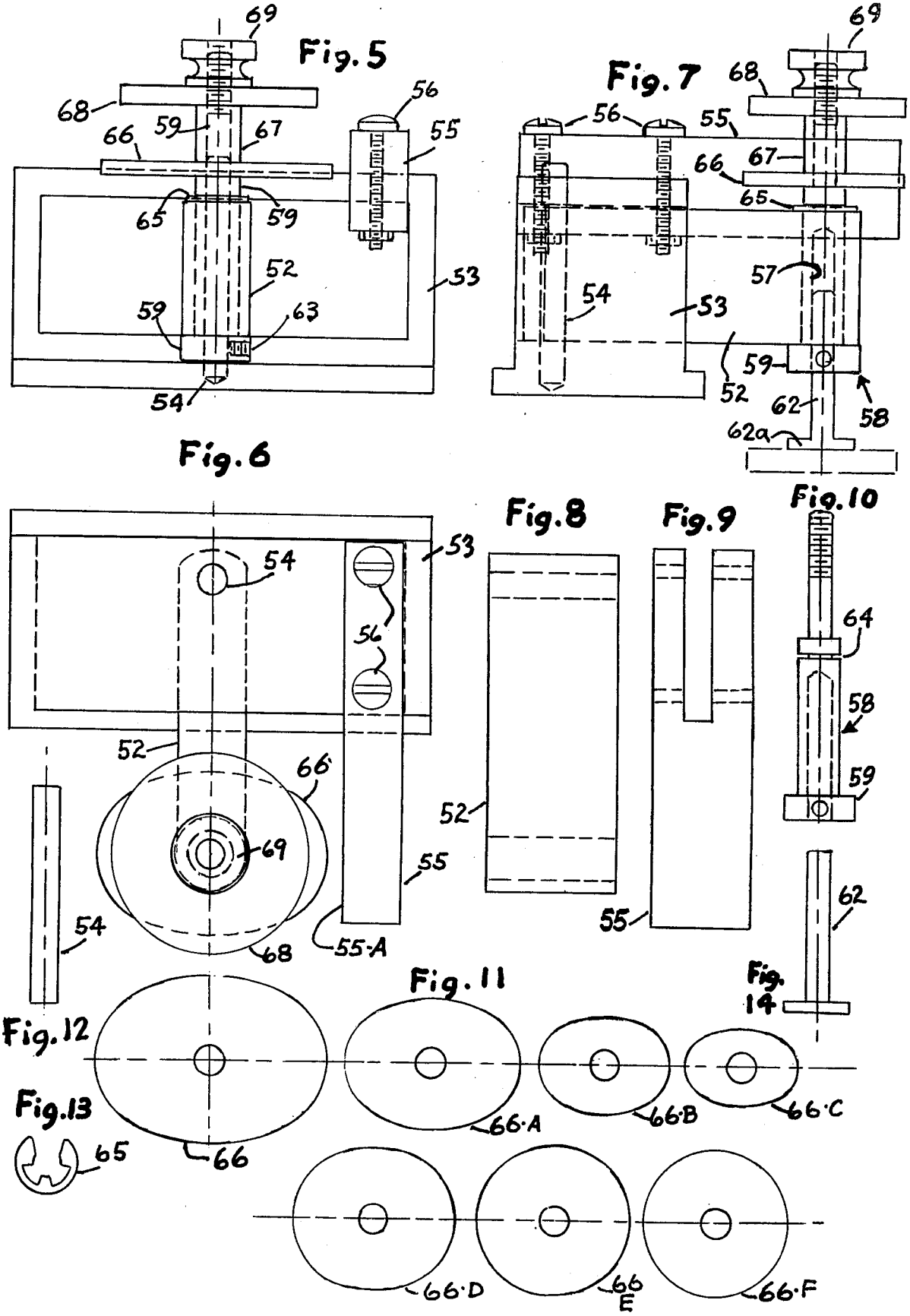
FIGS. 5, 6 and 7 are side, top and end views, respectively, of the slide member and components carried thereby.
FIGS. 8, 9 and 10 are side views of the swing arm, guide bar and arbor components, respectively.
FIG. 11 is a plan view of a series of templates used in the present invention.
FIGS. 12 and 13 are elevation and plan view, respectively, of the pivot pin and snap ring components.
FIG. 14 is an elevational view of a typical dop.
Figure 15:
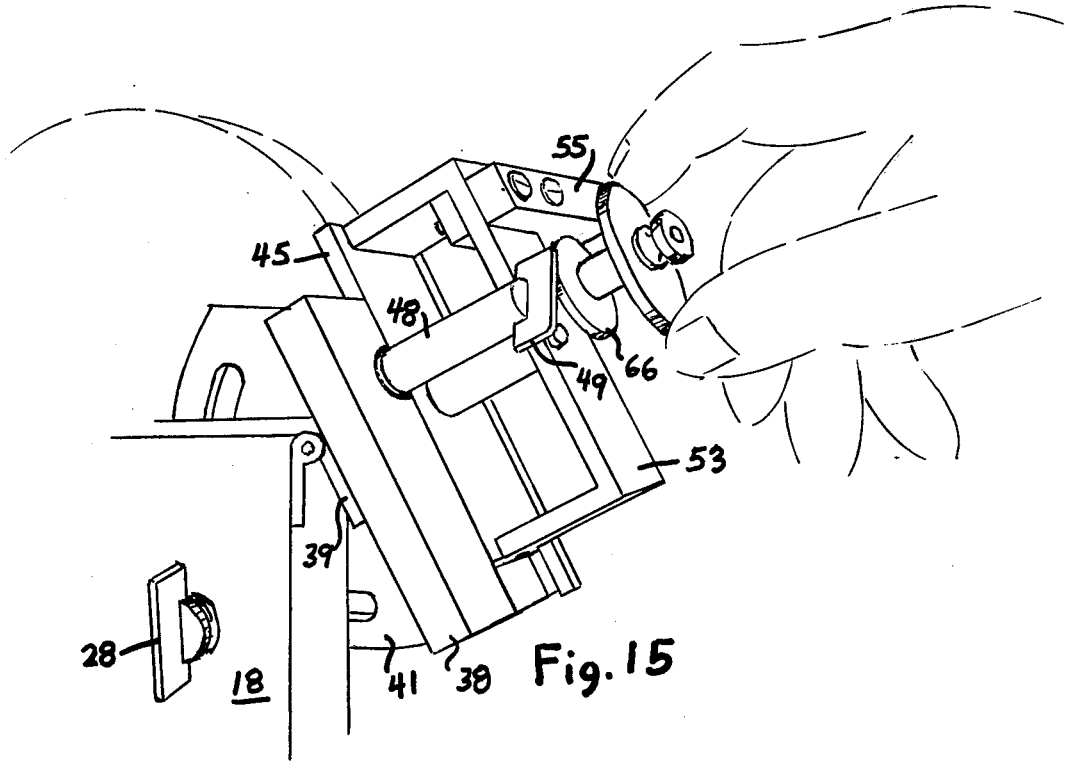
FIGS. 15 and 16 are perspective views showing the invention in operation.
Figure 16:
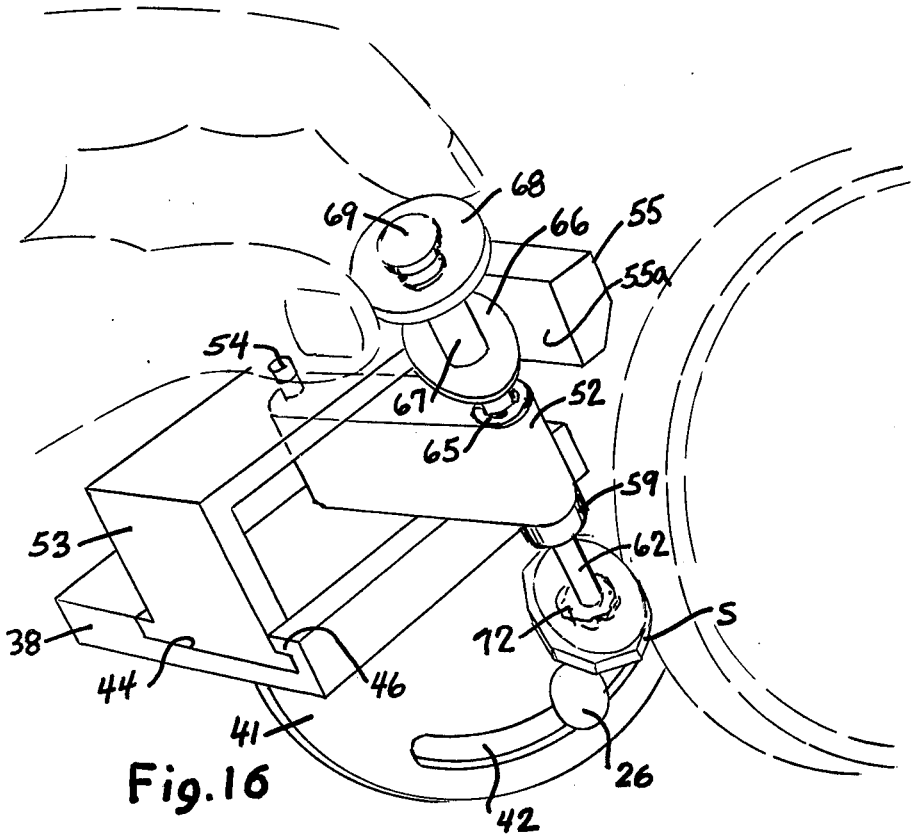

As shown in FIG. 11, the templates 66 can be various sizes and shapes. For example, templates 66*a* through 66*c* can be 40×30, 30×22, and 25×15, respectively. They can be used, for example, to respectively make smaller cabochons of 25×15, 16×8, and 16×9, respectively. Templates, 66*d* and 66*e* illustrate shapes which are not true ellipses and template 66*f* is circular. These shapes are by way of example only since an infinite number of shapes can be used for duplication.

I claim:

1. In combination, a grinding machine having a grinding wheel with a rotary axis and a grinding surface; and a fixture for a workpiece to be ground comprising, a mounting base presenting an elongated slideway defining a slide plane, means for swing mounting the mounting base on the grinding machine to swing toward and away from the grinding surface about a swing axis extending parallel to said slide plane and laterally at right angles relative to the length of said slideway, elongated slide means in the slideway arranged to selectively slide in a fore and aft direction along the slideway toward and away from the grinding surface, clamping means for holding said slide means against movement from a selected position along the slideway, a guide bar on the slide means projecting laterally beyond one longitudinal side of the slide means and mounting base and presenting a planar guide face occupying a plane perpendicular to said slide plane, a swing arm pivotally mounted on the slide means on a pivotal axis perpendicular to said slide plane and projecting by its free end in the same general direction as said guide bar, said swing arm presenting a journal near its free end which is parallel to said pivotal axis, means rotatably mounted in said journal for holding a template opposite said guide face and for holding a workpiece coaxially of said template and opposite said grinding surface whereby the workpiece may be in engagement with the grinding surface while the template is turned while in engagement with the guide face.

2. The combination according to claim 1 in which said grinding surface is the peripheral face of said wheel, and said swing mounting means has a swing axis parallel to the rotary axis of the grinding wheel.

3. The combination according to claim 1 in which said swing mounting means includes two registering hinge leafs, one on the fixture and the other on the machine, and a removable hinge pin.

* * * * *